US010928768B2

(12) United States Patent
Matsuda et al.

(10) Patent No.: US 10,928,768 B2
(45) Date of Patent: Feb. 23, 2021

(54) CLEANING UNIT, CARTRIDGE, IMAGE FORMING APPARATUS

(71) Applicant: CANON KABUSHIKI KAISHA, Tokyo (JP)

(72) Inventors: Kohei Matsuda, Fujisawa (JP); Hiraku Sasaki, Susono (JP); Hiroki Ogino, Mishima (JP); Kentaro Kawata, Suntou-gun (JP); Shun Sato, Minamiashigara (JP); Yasushi Katsuta, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/826,408

(22) Filed: Mar. 23, 2020

(65) Prior Publication Data

US 2020/0310334 A1 Oct. 1, 2020

(30) Foreign Application Priority Data

Mar. 29, 2019 (JP) ..... JP2019-067307

(51) Int. Cl.
*G03G 21/10* (2006.01)
*G03G 15/08* (2006.01)
(Continued)

(52) U.S. Cl.
CPC ..... *G03G 21/105* (2013.01); *G03G 15/0896* (2013.01); *G03G 21/0011* (2013.01); *G03G 21/12* (2013.01)

(58) Field of Classification Search
CPC .. G03G 21/1857; G03G 21/105; G03G 21/12; G03G 21/0011; G03G 15/0896
See application file for complete search history.

(56) References Cited

U.S. PATENT DOCUMENTS 7,245,867 B2 7/2007 Baek et al.
9,715,191 B2 7/2017 Ogino et al.
(Continued)

FOREIGN PATENT DOCUMENTS

JP 2006-031006 A 2/2006
JP 2014-174227 A 9/2014
(Continued)

OTHER PUBLICATIONS

U.S. Appl. No. 16/826,474, filed Mar. 23, 2020 (First Named Inventor: Hiroki Ogino).
(Continued)

*Primary Examiner* — Walter L Lindsay, Jr.
*Assistant Examiner* — Jessica L Eley
(74) *Attorney, Agent, or Firm* — Venable LLP

(57) ABSTRACT

Provided are a cleaning member that scrapes developer from a photosensitive drum attached to an opening of a cleaning frame, and a transport member that transports scraped developer from an opening side of the frame towards an opposing deep side. The transport member is driven such that an absolute value of maximum acceleration at the time of movement of the transport sheet in a direction from the opening side towards the deep side is smaller than an absolute value of maximum acceleration at the time of movement in a reverse direction of the former direction. In the longitudinal direction of the photosensitive drum, the width of the transport member is smaller than an abutting width of an abutting portion of the cleaning member with the photosensitive drum, and ends of the transport member in the longitudinal direction are positioned inward of ends of the abutting portion.

16 Claims, 11 Drawing Sheets

(51) Int. Cl.
*G03G 21/00* (2006.01)
*G03G 21/12* (2006.01)

(56) References Cited

U.S. PATENT DOCUMENTS

| | | | | |
|---|---|---|---|---|
| 2006/0159497 | A1* | 7/2006 | Choi | G03G 21/0011 399/358 |
| 2008/0226367 | A1* | 9/2008 | Kim | G03G 21/12 399/358 |
| 2014/0199096 | A1* | 7/2014 | Yoshida | G03G 15/0874 399/258 |
| 2015/0093153 | A1* | 4/2015 | Ogino | G03G 15/0865 399/258 |

FOREIGN PATENT DOCUMENTS

| | | | |
|---|---|---|---|
| JP | 2015-092226 | A | 5/2015 |
| JP | 2016-184142 | A | 10/2016 |

OTHER PUBLICATIONS

U.S. Appl. No. 16/820,758, filed Mar. 17, 2020 (First Named Inventor: Shun Sato).

* cited by examiner

FIG.6

| LONGITUDINAL WIDTH RELATIONSHIP | OCCURRENCE OF TUCK-UP BY 10000 PRINTS |
|---|---|
| CLEANING BLADE 11a > WASTE TONER TRANSPORT MEMBER 12b | NO |
| WASTE TONER TRANSPORT MEMBER 12b > CLEANING BLADE 11a | YES |

CLEANING UNIT, CARTRIDGE, IMAGE FORMING APPARATUS

BACKGROUND OF THE INVENTION

Field of the Invention

The present invention relates to a cleaning unit and to a cartridge used in an image forming apparatus.

The term image forming apparatus denotes for instance an electrophotographic copier, an electrophotographic printer (for instance a laser beam printer or an LED printer), a facsimile machine or the like, in which an image is formed on a recording medium (recording material) relying on an electrophotographic image formation scheme.

Description of the Related Art

Japanese Patent Application Publication No. 2015-92226 discloses a configuration in which a plate-shaped transport member is used as member for transporting a developer that is accommodated in the interior of a developer accommodating container configured to be attachable to and detachable from the apparatus body of an image forming apparatus.

SUMMARY OF THE INVENTION

The above-described configuration in Japanese Patent Application Publication No. 2015-92226 can be conceivably adopted in waste toner transport member for transporting waste toner that is accommodated in the interior of a cleaning container i.e. can be adopted in transport member for transporting, to the back of a developer accommodating part, waste toner having been removed from a photosensitive drum by a cleaning member. The term waste toner denotes toner (developer) that remains on the surface of a photosensitive drum, as an image bearing member, without being transferred to a recording material or the like, at the time of transfer of a toner image (developer image) supported on the photosensitive drum, to the recording material or the like. It was found that the following problems may arise in such a case.

The configuration of Japanese Patent Application Publication No. 2015-92226 provides a plate-shaped transport member disposed below a powder, and an oscillation imparting member that imparts reciprocating acceleration in a transport surface direction along a powder transport surface of the plate-shaped transport member. In a case where the plate-shaped transport member is used as a waste toner transport member, this waste toner transport member is imparted with acceleration, by an oscillation imparting member, in such a manner that the acceleration of the waste toner transport member in an opposing direction of a waste toner transport direction is larger than the acceleration of the waste toner transport member in the waste toner transport direction. As a result it becomes possible to transport the waste toner towards the rear of the cleaning container.

Studies by the authors have revealed that such a waste toner transport member exhibits very high waste toner transport ability in the transport of waste toner. When transport ability is increased through the use of this waste toner transport member, the waste toner having entered the cleaning container is transported immediately towards the rear of the cleaning container. As a result, not much waste toner accumulates in the vicinity of the leading end of the cleaning blade, and hence lubricity between the cleaning blade and the photosensitive drum may drop as a result.

Further, tuck-up of the cleaning blade is suppressed in the vicinity of the longitudinal-direction ends of the cleaning blade, and therefore lubricity between the cleaning blade and the photosensitive drum must be secured by a given amount of waste toner. However it was found that when transport ability is increased through the use of the above waste toner transport member, tuck-up of the cleaning blade may occur, and the waste toner amount necessary in order to secure lubricity between the cleaning blade and the photosensitive drum fails to be obtained.

It is an object of the present invention to provide a scheme that allows transporting a developer removed (scraped) from the surface of an image bearing member towards a developer accommodating part, with greater space savings and more efficiently, in a stable operation.

With a view to attaining the above goal, a cleaning unit of the present invention has:

a frame which is provided with an opening for attaching an image bearing member;

a blade member which has an abutting portion to abut on a surface of the image bearing member attached to the frame and which scrapes a developer from the surface of the image bearing member;

a transport sheet which is provided inside the frame and which transports the developer scraped by the blade member, from an opening side of the frame to a deep side of the frame, the deep side being opposite to the opening side; and a driving unit which drives the transport sheet;

wherein the transport sheet is driven by the driving unit such that an absolute value of maximum acceleration at the time of movement of the transport sheet in a direction from the opening side towards the deep side is smaller than an absolute value of maximum acceleration at the time of movement in a direction from the deep side towards the opening side;

wherein, in a longitudinal direction of the image bearing member, the width of the transport sheet is smaller than an abutting width of the blade member at the abutting portion, and an end of the transport sheet is disposed so as to be positioned inward of an end of the abutting portion.

With a view to attaining the above goal, a cartridge of the present invention, attachable to and detachable from a main body of an image forming apparatus, has:

an image bearing member;

a developer carrier that carries a developer for developing an electrostatic image formed on the image bearing member; and a cleaning unit;

wherein the cleaning unit includes:

a frame which is provided with an opening for attaching the image bearing member;

a blade member which has an abutting portion to abut a surface of the image bearing member attached to the frame and which scrapes a developer from the surface of the image bearing member;

a transport sheet which is provided inside the frame and which transports the developer scraped by the blade member, from an opening side of the frame to a deep side of the frame, the deep side being opposite to the opening side; and a driving unit which drives the transport sheet;

wherein the transport sheet is driven by the driving unit such that an absolute value of maximum acceleration at the time of movement of the transport sheet in a direction from the opening side towards the deep side, is smaller than an absolute value of maximum acceleration at the time of movement in a direction from the deep side towards the opening side;

wherein, in a longitudinal direction of the image bearing member, the width of the transport sheet is smaller than an abutting width of the blade member at the abutting portion, and an end of the transport sheet is disposed so as to be positioned inward of an end of the abutting portion.

With a view to attaining the above goal, an image forming apparatus of the present invention has:

a main body; and a cartridge of the present invention, attachable to and detachable from the main body;

the cartridge includes:

an image bearing member;

a developer carrier that carries a developer for developing an electrostatic image formed on the image bearing member; and a cleaning unit;

wherein the cleaning unit includes:

a frame which is provided with an opening for attaching the image bearing member;

a blade member which has an abutting portion to abut a surface of the image bearing member attached to the frame and which scrapes a developer from the surface of the image bearing member;

a transport sheet which is provided inside the frame and which transports the developer scraped by the blade member, from an opening side of the frame to a deep side of the frame, the deep side being opposite to the opening side; and a driving unit which drives the transport sheet;

wherein the transport sheet is driven by the driving unit such that an absolute value of maximum acceleration at the time of movement of the transport sheet in a direction from the opening side towards the deep side, is smaller than an absolute value of maximum acceleration at the time of movement in a direction from the deep side towards the opening side;

wherein, in a longitudinal direction of the image bearing member, the width of the transport sheet is smaller than an abutting width of the blade member at the abutting portion, and an end of the transport sheet is disposed so as to be positioned inward of an end of the abutting portion.

The present invention allows transporting a developer removed (scraped) from the surface of an image bearing member towards a developer accommodating part, with greater space savings and more efficiently, in a stable operation.

Further features of the present invention will become apparent from the following description of exemplary embodiments with reference to the attached drawings.

BRIEF DESCRIPTION OF THE DRAWINGS

FIG. 6 is a diagram illustrating assessment results of a comparative example in Embodiment 1;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

In the explanation below, the longitudinal direction of a cartridge and various members is a direction parallel, or substantially parallel, to the axial direction of an image bearing member. Left and right denote herein left and right with the recording material viewed from above, along the transport direction of a recording material. The top face of the cartridge and of the various members is the surface positioned at the top, and the lower face is the surface positioned at the bottom, in a state where the cartridge is fitted to the apparatus body.

Embodiment 1

Overall Description of Image Forming Apparatus

Figure 1:
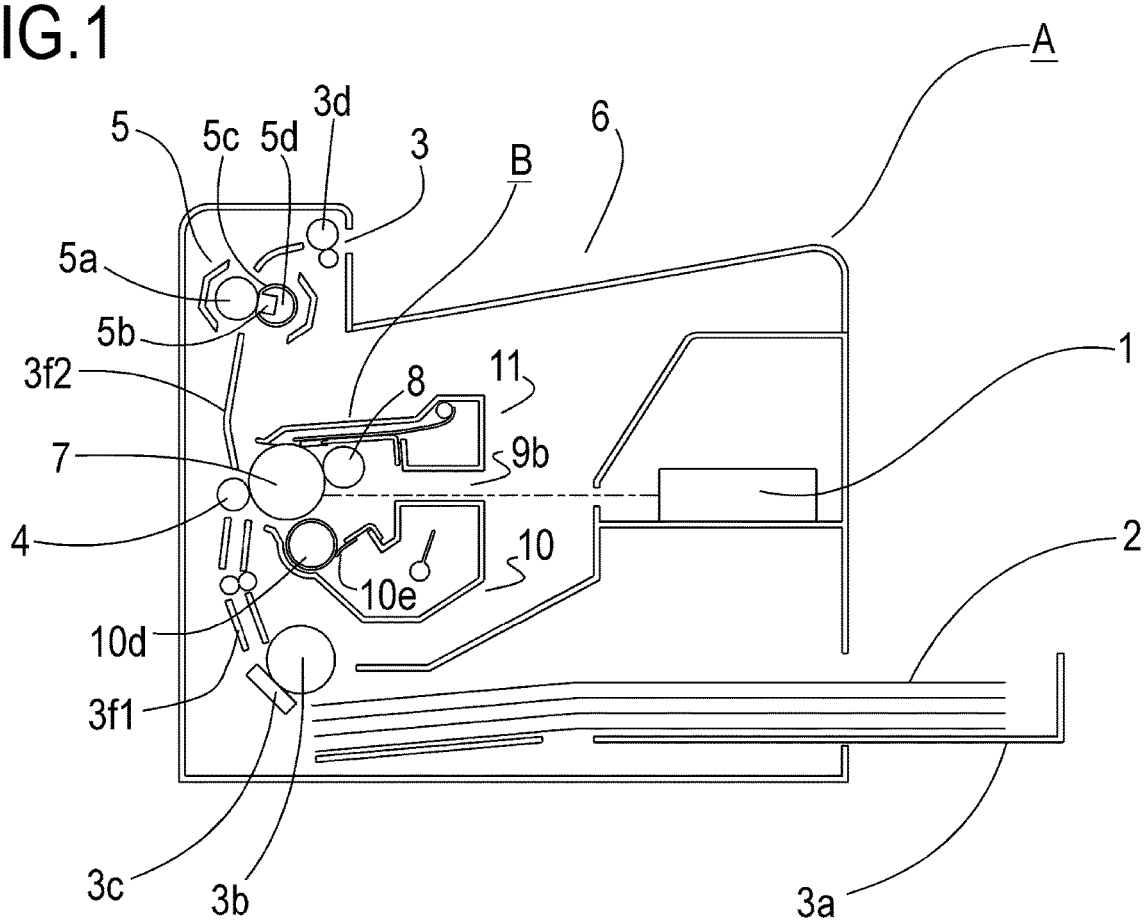
FIG. 1 is a cross-sectional diagram of an image forming apparatus in Embodiment 1.

The overall structure of an electrophotographic image forming apparatus (hereafter image forming apparatus) will be explained next with reference to FIG. 1. FIG. 1 is a schematic cross-sectional diagram of an image forming apparatus fitted with a cartridge B according to Embodiment 1 of the present invention. More specifically, FIG. 1 is a schematic cross-sectional diagram of a laser beam printer which is one implementation of an image forming apparatus.

Figure 2:
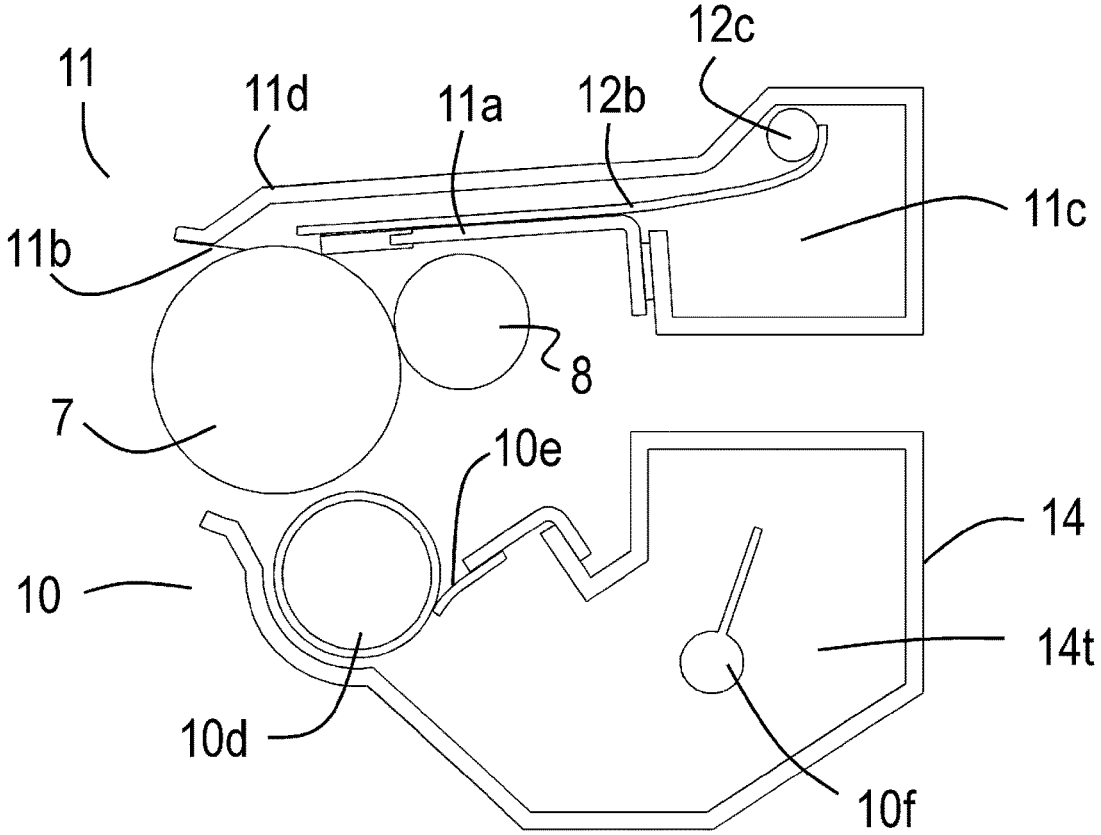
FIG. 2 is a diagram of a cartridge in Embodiment 1.
Figure 3:
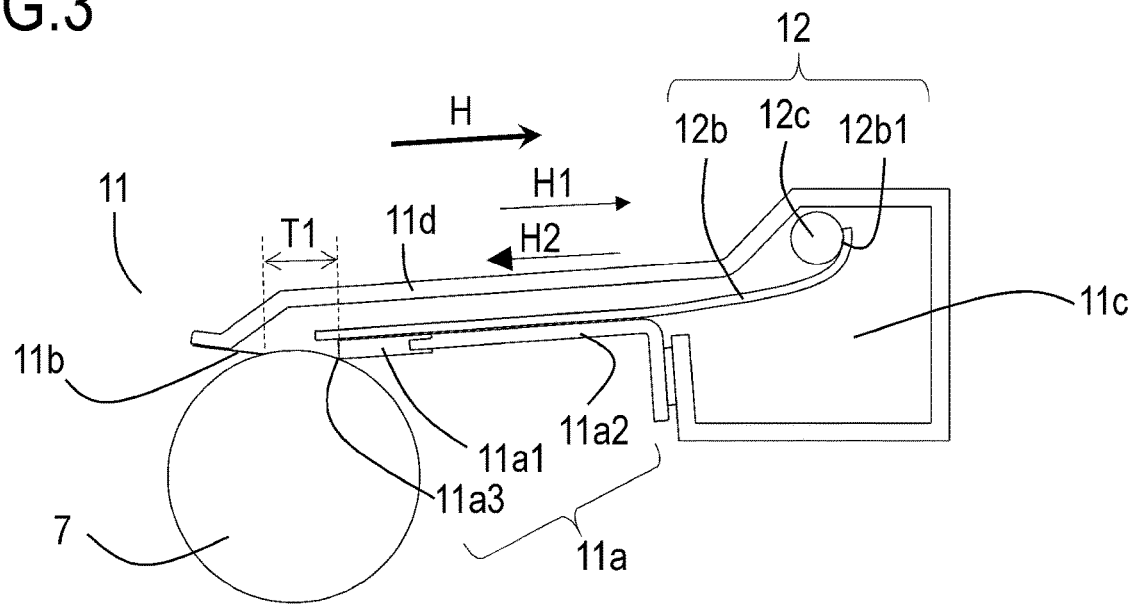
FIG. 3 is a diagram of a cleaning unit in Embodiment 1.

The attitudes of the image forming apparatus, process cartridge and cleaning unit 11 illustrated in FIG. 1 to FIG. 3 are attitudes at the time of use of the image forming apparatus. The positional relationships, directions and so forth of the various members in the present specification denote positional relationships, directions and so forth in these attitudes. Specifically, a top-bottom direction on the paper in FIG. 1 to FIG. 3 corresponds to a vertical direction, and a left-right direction on the paper corresponds to a horizontal direction. The setting of the arrangement configuration is premised on the image forming apparatus being installed on a horizontal plane, as an ordinary installation state.

The dimensional relationships between the various members in FIG. 5A, FIG. 5B and FIG. 7 to FIG. 11 are premised on an arrangement (central reference) in which a process cartridge (cleaning unit 11) is fitted to the apparatus body, i.e. the longitudinal centers of the members are aligned, as the arrangement during normal use.

As illustrated in FIG. 1, an image forming apparatus (laser beam printer) is provided with an image forming apparatus body (hereafter main body) A, and with a cartridge B attachable to and detachable from the main body A. A photosensitive drum 7 as an image bearing member is disposed in the interior of the main body A.

The image forming apparatus according to the present example irradiates information light (laser light) based on image information, from an optical system 1 as an optical unit (optical device), onto a drum-shaped photosensitive drum 7, to form an electrostatic latent image on the peripheral surface of the photosensitive drum 7. The electrostatic latent image is developed into a toner image (developer image) by a developer (hereafter referred to as "toner") on the peripheral surface of the photosensitive drum 7. In synchrony with formation of the toner image, a recording material (for instance recording paper, an OHP sheet, cloth or the like) 2 is separated and fed from a cassette 3*a*, sheet by sheet, by a pick up roller 3*b* and a pressing member 3*c* that is pressed against the pick up roller 3*b*.

The recording material 2 thus fed is transported, along a transport guide 3*f*1, up to a transfer section in which the photosensitive drum 7 of the cartridge B and a transfer roller 4 as a transfer member oppose each other. A toner image formed on the photosensitive drum 7 by the transfer roller 4 having voltage applied thereto is transferred to the recording material 2 having been transported to the transfer section, and the recording material 2 is transported to a fixing apparatus 5 along a transport guide 3*f*2.

The fixing apparatus 5 is made up of a driver roller 5*a*, and a fixing rotating member 5*c* having a heater 5*b* built therein and made up of a tubular sheet that is rotatably supported by a support 5*d*, such that the fixing rotating member 5*c* fixes the transferred toner image through application of heat and pressure to passing recording material 2.

The discharge rollers 3*d* are configured to transport the recording material 2 having the toner image fixed thereto, and discharge the recording material 2 to a discharge section 6, via a reverse transport path. In the present example the transport device 3 is for instance made up of the pick up roller 3*b*, the pressing member 3*c* and the discharge rollers 3*d*.

Cartridge

The overall structure of the cartridge B (process cartridge) will be explained next schematically with reference to FIG. 2. FIG. 2 is a schematic cross-sectional diagram of the cartridge B. As illustrated in FIG. 2, the cartridge B is provided with the photosensitive drum 7 and at least one process unit. Examples of the process unit include for instance a charging member for charging the photosensitive drum 7, a developing unit for developing the electrostatic latent image formed on the photosensitive drum 7, and a cleaning unit for cleaning toner remaining on the photosensitive drum 7.

The cartridge B has the below-described cleaning unit 11 and a developing unit 10.

Schematically, the cleaning unit 11 is made up of the photosensitive drum 7, a charging roller 8 and a cleaning frame 11*d*. The cleaning frame 11*d* is provided with a cleaning blade 11*a*, a scooping sheet 11*b*, a waste toner accommodating portion 11*c*, a waste toner transport member 12*b* and a transport shaft 12*c*. Although described in further detail below, toner having been removed (scraped) off the surface of the photosensitive drum 7 by the cleaning blade 11*a* as a cleaning member (blade member) is transported towards the deep side of the waste toner accommodating portion 11*c*, as a developer accommodating part, by the waste toner transport member 12*b* as a developer transport member (transport sheet). The waste toner transport member 12*b* can move relatively to the cleaning blade 11*a* on account of rotation (swinging) of the transport shaft 12*c*, as a rotating shaft, which rotates upon reception of a driving force from a driving source such as a motor, not shown. The relative movement of the waste toner transport member 12*b* is herein a reciprocating movement between the surface side of the photosensitive drum 7 and the deep side of the waste toner accommodating portion 11*c*.

The developing unit 10 is made up of the developing roller 10*d*, a developing blade 10*e*, and an accommodating container 14 having a stirring member 10*f* built therein. Toner is held in a toner accommodating section 14*t* in the interior of the accommodating container 14.

The direction in which the waste toner transport member 12*b* transports the waste toner in the above configuration is a waste toner transport direction H1 (see FIG. 3) from a cleaning portion 11*a*3 of the cleaning blade 11*a* towards the waste toner accommodating portion 11*c* (i.e. a direction from the opening side of the cleaning frame 11*d* towards the deep side on the opposite side of the opening). FIG. 3 illustrates also a movement direction H2 as an opposite direction (reverse direction) of the waste toner transport direction.

The image formation process in the cartridge B will be explained with reference to FIG. 1 and FIG. 2.

Firstly, the photosensitive drum 7 having a photosensitive layer is caused to rotate, and the surface of the photosensitive drum 7 is charged uniformly through application of voltage to the charging roller 8 which is a charging member. The charged photosensitive drum 7 is exposed with information light (light image) based on image information from the optical system 1, via an exposure opening 9*b*. An electrostatic latent image (electrostatic image) becomes formed on the surface of the photosensitive drum 7, and the electrostatic latent image is developed by the developing unit 10. The developing unit 10 is also referred to as a developing apparatus.

The developing unit 10 rotatably supports the developing roller 10*d* as a developer carrier that carries developer. A toner layer imparted with triboelectric charge by the developing blade 10*e* becomes formed, accompanying this rotation, on the surface of the developing roller 10*d* (i.e. a toner coat region (developer coated region) is formed). This toner is caused to migrate (developing unit) to the photosensitive drum 7 in accordance with the electrostatic latent image, to thereby yield a visible image as a toner image.

Voltage of reverse polarity to that of the toner image is then applied to the transfer roller 4, to transfer the toner image from the photosensitive drum 7 to the recording material 2; thereafter, for instance untransferred toner remaining on the photosensitive drum 7 is scraped off by the cleaning blade 11*a* that is fixed to the cleaning frame 11*d* illustrated in FIG. 2. Concurrently, the untransferred toner is scooped by the scooping sheet 11*b* and gathered in the waste toner accommodating portion 11*c* by the waste toner transport member 12*b*. Residual toner on the photosensitive drum 7 is thus removed (scraped) by these cleaning unit.

The image formation process of the cartridge B is configured thus in the above manner.

Configuration of Cleaning Unit and Waste Toner Transport Mechanism

Figure 4:
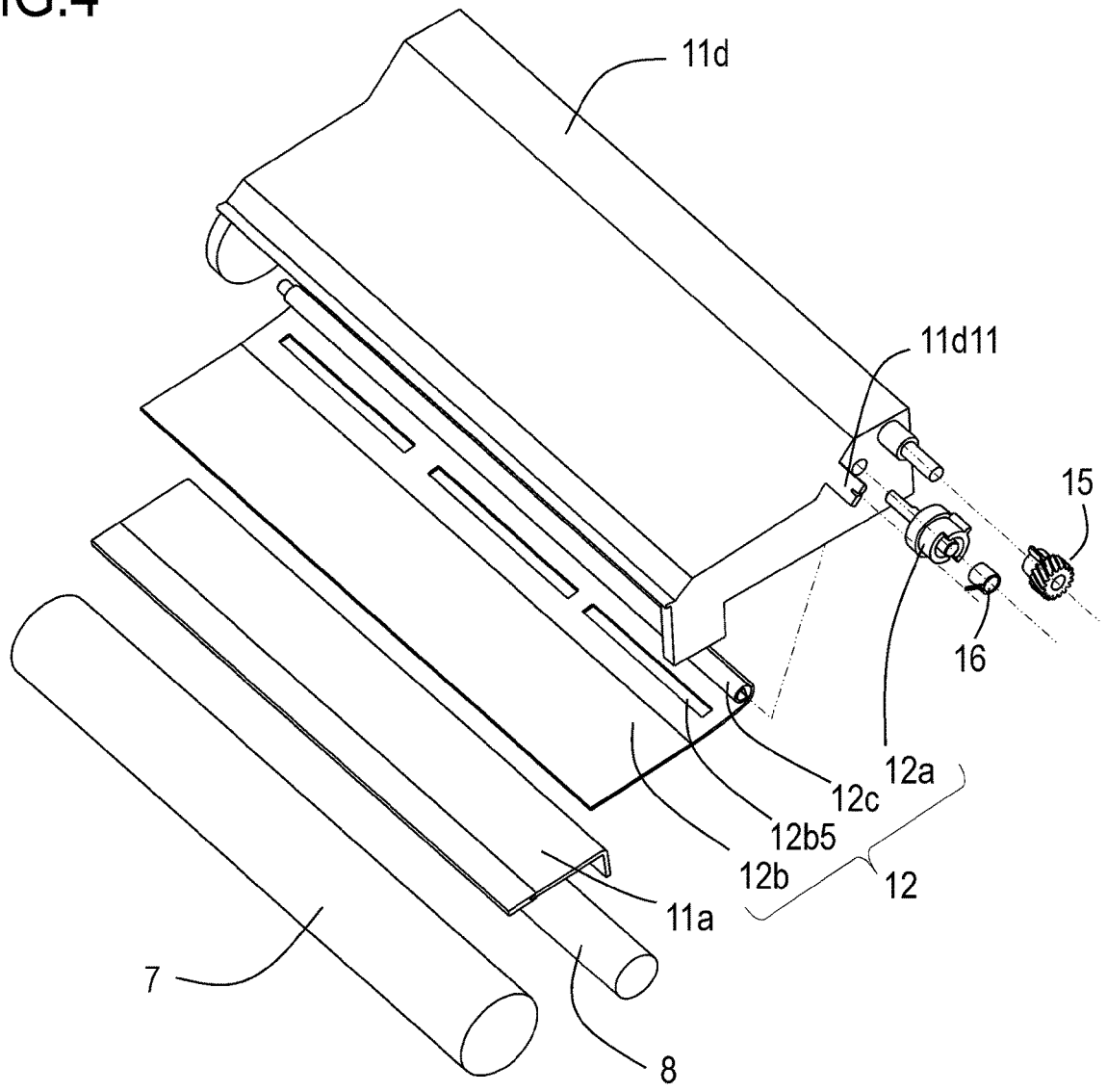
FIG. 4 is an assembly perspective-view diagram of the cleaning unit in Embodiment 1.

The configuration of the cleaning unit 11 and of the waste toner transport mechanism 12 will be explained next with reference to FIG. 3 and FIG. 4.

As illustrated in FIG. 3, the cleaning unit 11 is provided with the photosensitive drum 7, the cleaning blade 11*a*, the charging roller 8, the waste toner transport mechanism 12, the cleaning frame 11*d*, the waste toner accommodating portion 11*c* and the scooping sheet 11*b*. The waste toner transport mechanism 12 is made up of the waste toner transport member 12*b*, the transport shaft 12*c*, a swinging rotating member 12*a* as an actuated member, a rotating member 15 as an actuating member, and a spring member 16.

The cleaning blade 11*a* is made up of a rubber part 11*a*1 and a sheet metal part 11*a*2, attached to the cleaning frame 11*d*. The abutting portion between the rubber part 11*a*1 of the cleaning blade 11*a* and the photosensitive drum 7 is referred to as the cleaning portion 11*a*3. The cleaning blade 11*a* is disposed so as to extend from one end thereof fixed to the cleaning frame 11*d* towards the other end that abuts on the surface of the photosensitive drum 7, in a direction opposite to the rotation direction of the photosensitive drum 7 at the region at which the other end of the cleaning blade 11*a* abuts on the surface of the photosensitive drum 7.

The cleaning frame 11*d* has an opening for attaching the photosensitive drum 7, the opening being plugged by the photosensitive drum 7 attached to the cleaning frame 11*d*, the cleaning blade 11*a* and the scooping sheet 11*b*.

The waste toner transport member 12*b* is a sheet-shaped elastic member (sheet-shaped member having pliability) for transporting waste toner. The waste toner transport member 12*b* is made up of a sheet member having a thickness of 0.1 mm, and is fixed to the transport shaft 12*c*, which is connected to the below-described swinging rotating member 12*a*, at a fixing portion 12*b*1 which is one end of the sheet member. Further, communicating holes (through-hole) 12*b*5 for accommodating waste toner on the top face of the waste toner transport member 12*b* into the waste toner accommodating portion 11*c*, are provided in the vicinity of the transport shaft 12*c* of the waste toner transport member 12*b*. The side of the waste toner transport member 12*b* abutting on the cleaning blade 11*a*, and the side opposite thereto, communicate with each other via the communicating holes 12*b*5. In the present example the material used in the waste toner transport member 12*b* is polyethylene terephthalate (PET), but the material is not limited thereto.

The driving structure (driving unit) of the waste toner transport member 12*b* will be explained next with reference to FIG. 4. As illustrated in FIG. 4, the swinging rotating member 12*a*, the rotating member 15 and the fixing portion 11*d*11 are provided on the outer wall of the cleaning frame 11*d*. The swinging rotating member 12*a* elicits rotation of the transport shaft 12*c*, having the waste toner transport member 12*b* fixed thereto. The rotating member 15 receives a driving force from a driving source (motor or the like), not shown, in the main body A, and drives the swinging rotating member 12*a*. The fixing portion 11*d*11 is provided for the purpose of fixing the spring member 16 that is attached to the swinging rotating member 12*a*. The spring member 16 made up of a torsion coil spring is attached to the swinging rotating member 12*a*.

The rotating member 15 is made up of a step gear having a two-tooth missing gear and a gear that receives a continuously rotating driving force from a driving force transmission gear (not shown) provided in the main body A. As a result of rotation of the rotating member 15, the two-tooth missing gear acts on the swinging rotating member 12*a*, to cause the waste toner transport member 12*b* to oscillate by being imparted with reciprocating acceleration in the movement directions H1 and H2, via the transport shaft 12*c*. In the present Embodiment 1, the absolute value of the maximum acceleration in the H2 direction is set to be larger than the absolute value of the maximum acceleration in the H1 direction. Waste toner above and below the waste toner transport member 12*b* becomes transported as a result towards the waste toner accommodating portion 11*c*. In the present Embodiment 1 the rotational speed of the rotating member 15 was set to 300 rpm, the frequency of the force applied to the swinging rotating member 12*a* by the rotating member 15 was set to 30 Hz, and the angle at which the swinging rotating member 12*a* turns as a result of the action of the rotating member 15 thereon was set to 30°.

Figure 5A:
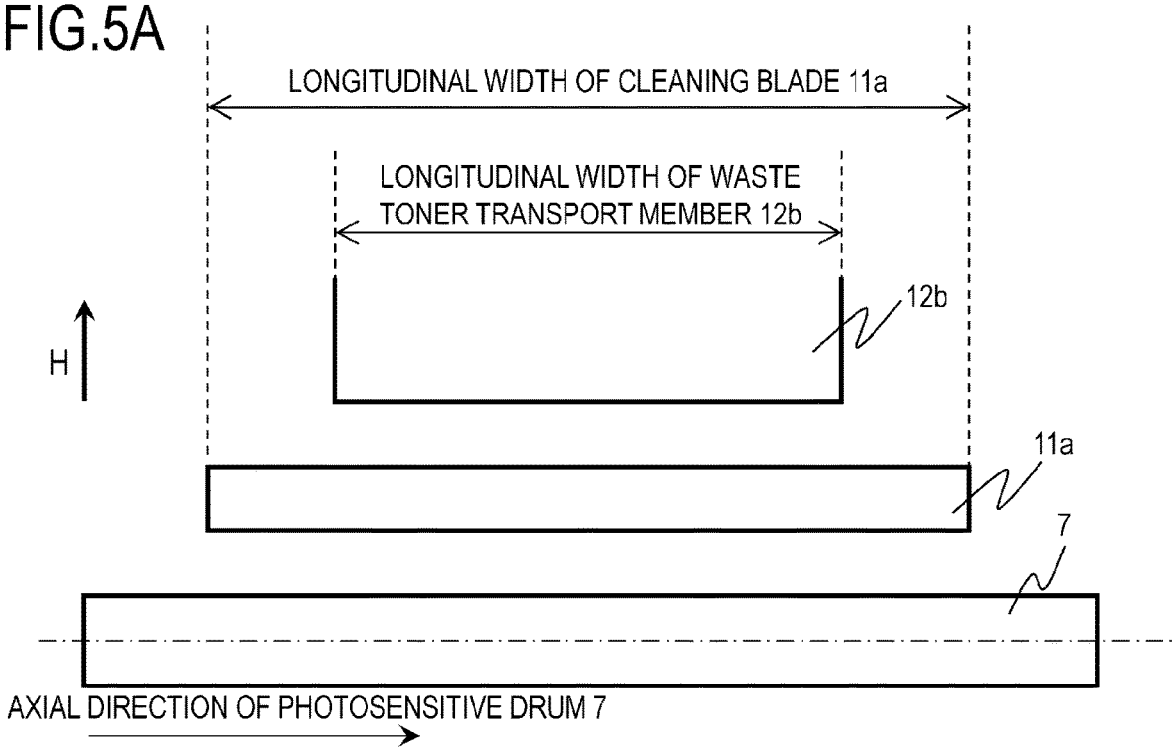
FIG. 5A and FIG. 5B are a set of relationship diagrams of longitudinal widths in Embodiment 1.
Figure 5B:
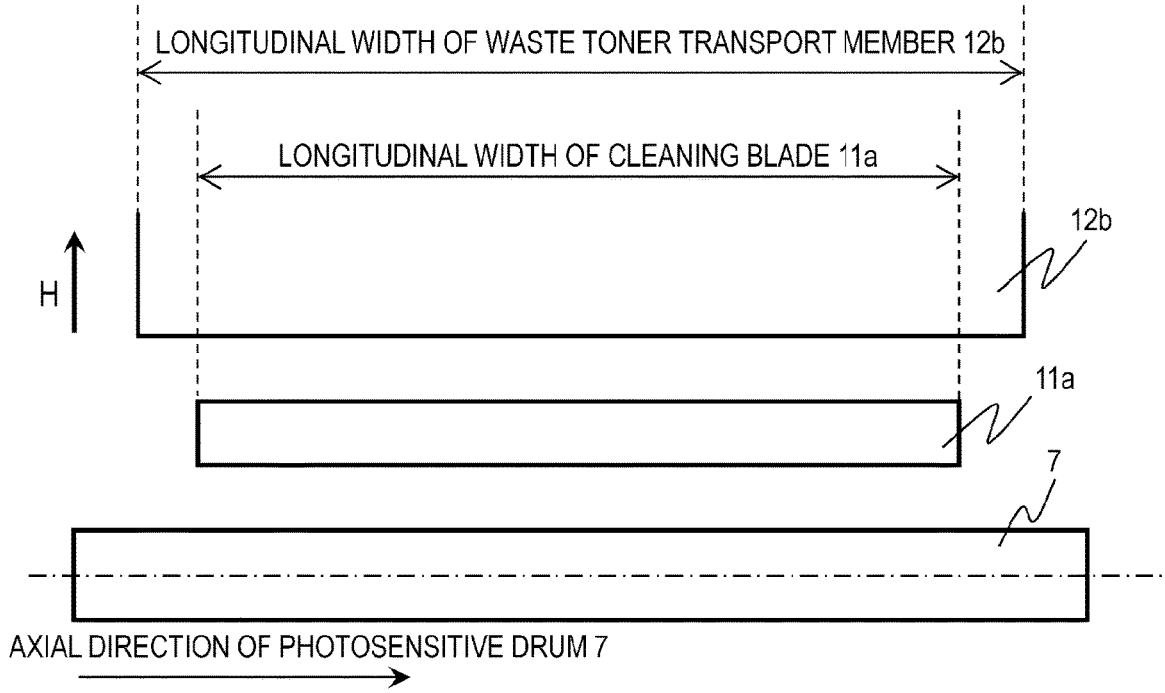

Longitudinal Positional Relationship Between Cleaning Blade and Waste Toner Transport Member An explanation follows next, with reference to FIG. 5A and FIG. 5B, on a relationship between the widths (longitudinal width) of the cleaning blade 11*a* and of the waste toner transport member 12*b* in the longitudinal direction (rotation axis direction of the photosensitive drum 7). FIG. 5A and FIG. 5B illustrate a relationship between the longitudinal widths of the cleaning blade 11*a*, the waste toner transport member 12*b* and the photosensitive drum 7. The direction in which waste toner is transported is denoted as the waste toner transport direction H. The longitudinal widths of the cleaning blade 11*a* and the waste toner transport member 12*b* explained herein denote the width (abutting width) of the cleaning blade 11*a* and of the waste toner transport member 12*b* at an abutting portion with the photosensitive drum 7. The cleaning blade 11*a* and the waste toner transport member 12*b* in the configuration illustrated in FIG. 5A and FIG. 5B abut on the photosensitive drum 7 over the entirety of the cleaning blade 11*a* and the waste toner transport member 12*b*, in the longitudinal direction, and accordingly the widths of the foregoing over the entirety of the longitudinal direction, and the abutting widths, coincide with other.

Studies by the authors have revealed that the waste toner transport member 12*b* has very high waste toner transport ability. Specifically, in a case where transport ability is increased through the use of the waste toner transport member 12*b*, the waste toner collected in the cleaning unit 11 is transported immediately from the vicinity of the cleaning portion 11*a*3, and is fed to waste toner accommodating portion 11*c*. Therefore, the vicinity of the cleaning portion 11*a*3 is readily brought to a state of having very little waste toner. In particular, the concern of tuck-up of the cleaning blade 11*a* may arise in that the amount of waste toner necessary for ensuring the lubricity at the cleaning portion 11*a*3 may fail to be achieved in the vicinity of the longitudinal-direction ends of the cleaning blade 11*a*.

In the present Embodiment 1, therefore, the relationship between the longitudinal widths of the cleaning blade 11*a* and of the waste toner transport member 12*b* is prescribed to be "longitudinal width of the cleaning blade 11*a*>longitudinal width of the waste toner transport member 12*b*". By prescribing such a relationship the waste toner transport member 12*b* is not disposed in the vicinity of the cleaning blade 11*a* in the longitudinal direction. In consequence, transport of waste toner in the vicinity of the longitudinal-direction ends of the cleaning blade 11*a* is suppressed, and waste toner accumulates in the vicinity of the cleaning blade leading end. As a result the lubricity at the cleaning portion 11*a*3 in the vicinity of the longitudinal-direction ends of the cleaning blade 11*a* can be ensured, and the occurrence of tuck-up of the cleaning blade 11*a* can be suppressed.

COMPARATIVE EXAMPLE

An explanation follows next on the results of a comparative assessment of the instance illustrated in FIG. 5A (condition i) and the instance illustrated in FIG. 5B (condition ii), as a relationship between the longitudinal widths of the cleaning blade 11*a* and of the waste toner transport member 12*b*. The instance illustrated in FIG. 5A shows a case in which "longitudinal width of the cleaning blade 11*a*>longitudinal width of the waste toner transport member 12*b*" (condition i). The instance illustrated in FIG. 5B shows a case "longitudinal width of the waste toner transport member 12*b*>longitudinal width of the cleaning blade 11*a*" (condition ii).

For comparison purposes, a respective cartridge B produced under each of these two conditions was prepared. Specifically, a cartridge B obeying condition i and cartridge B obeying condition ii were prepared herein. The thickness and driving conditions of the waste toner transport member 12*b* were set to be identical to the conditions described above (rotational speed, frequency, angle), and only the longitudinal width of the waste toner transport member 12*b* was modified. The longitudinal width of the cleaning blade 11*a* was set to 240 mm, the longitudinal width of the waste toner transport member 12*b* under condition i was set to 220 mm and the longitudinal width of the waste toner transport member 12*b* under condition ii was set to 260 mm. The distance T1 between the leading end of the rubber part 11*a*1 of the cleaning blade 11*a* and the leading end of the scooping sheet 11*b* was set to about 2 mm, as illustrated in FIG. 3.

Each cartridge B according to the respective condition was fixed to the main body A, and 10000 prints were outputted. A printing operation with intermission every two prints (so-called two-sheet intermittent printing) was carried out herein. The occurrence or absence of tuck-up in the cleaning blade 11*a* during printing up to the 10000 prints, under each condition, was assessed. The results are illustrated in FIG. 6.

In the case of condition ii, where "longitudinal width of the waste toner transport member 12*b*>longitudinal width of the cleaning blade 11*a*" was prescribed, lubricity at the cleaning portion 11*a*3 worsened, and tuck-up of the cleaning blade 11*a* occurred. However in the case of condition i, i.e. where "longitudinal width of the cleaning blade 11*a*>longitudinal width of the waste toner transport member 12*b*" was prescribed, lubricity at the cleaning portion 11*a*3 was fully secured, and good images could be obtained, without tuck-up of the cleaning blade 11*a*.

As explained above, thus, tuck-up of the cleaning blade 11*a* can be suppressed by prescribing "longitudinal width of the cleaning blade 11*a*>longitudinal width of the waste toner transport member 12*b*".

In the present Example 1 the material used in the waste toner transport member 12*b* was polyethylene terephthalate (PET), but the material is not limited thereto, and the waste toner transport member 12*b* can be made up of a general plastic material, as appropriate. Examples thereof include polystyrene (PS), polyimide (PI), a polyphenylene sulfide resin (PPS), polyethylene (PE), polypropylene (PP), an ABS resin, polycarbonate (PC) and polyacetal (POM).

Embodiment 2

A second example of the present invention will be explained next.

In Embodiment 1, a relationship between the longitudinal widths of the cleaning blade 11*a* and the waste toner transport member 12*b* was explained. In the present Embodiment 2 a relationship is explained that includes also the longitudinal width of a toner coat region 10R on the developing roller 10*d*, in addition to the above longitudinal widths. The configuration of the main body A and of the cartridge B, as well as the material, thickness, driving condition and so forth of the waste toner transport member 12*b*, are identical to those in Embodiment 1, and will be omitted herein.

Figure 7:
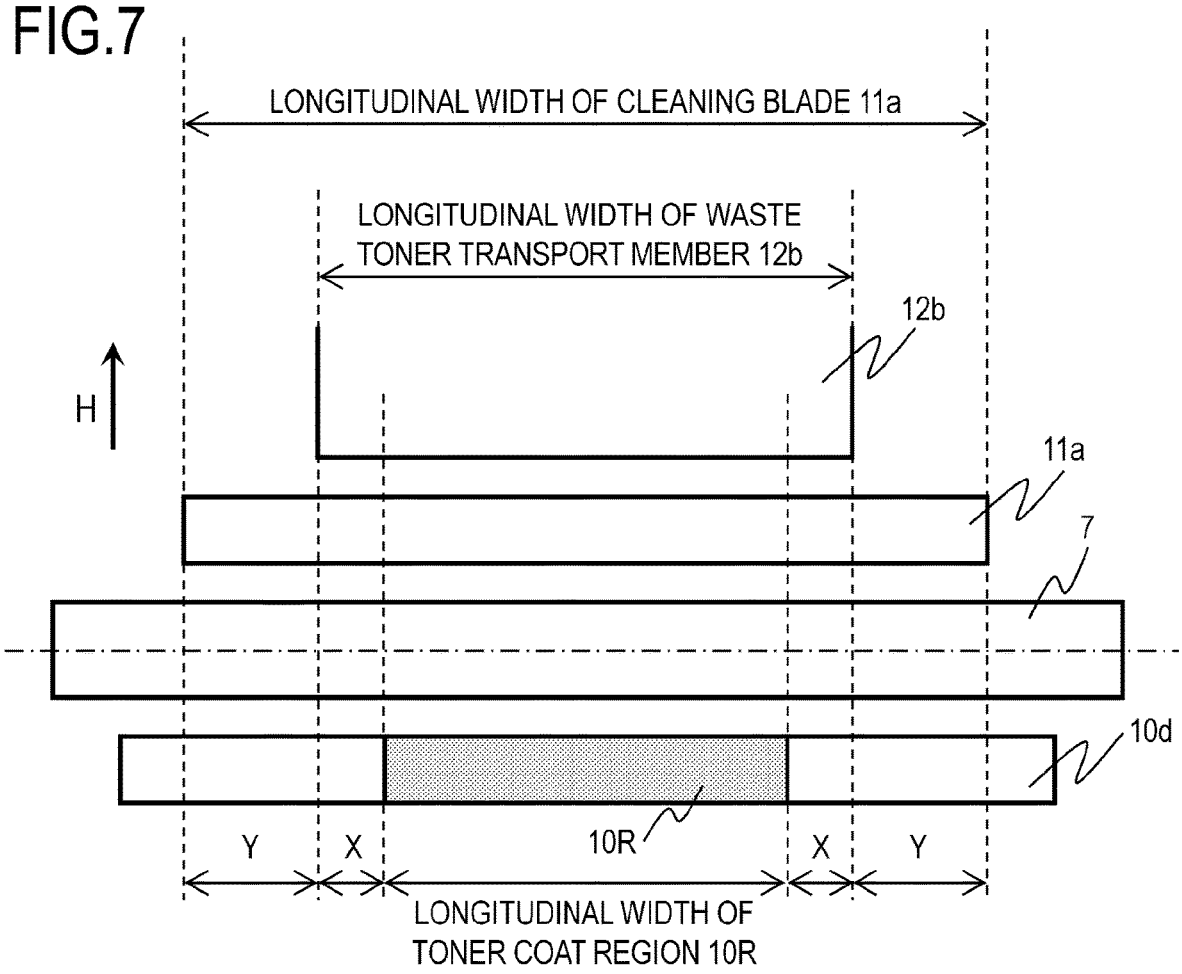
FIG. 7 is a relationship diagram of longitudinal widths in Embodiment 2.

Longitudinal Positional Relationship Between Cleaning Blade 11*a*, Waste Toner Transport Member 12*b* and Toner Coat Region 10R A relationship between the widths (longitudinal widths) of the cleaning blade 11*a*, the waste toner transport member 12*b* and the toner coat region 10R in the longitudinal direction will be explained next with reference to FIG. 7.

In Embodiment 1 an instance has been explained in which the longitudinal width of the waste toner transport member 12*b* is set to be smaller than the longitudinal width of the cleaning blade 11*a*, in order to suppress tuck-up of the cleaning blade 11*a* in the vicinity of the longitudinal-direction ends of the cleaning blade 11*a*. However, waste toner such as untransferred toner goes on being supplied, throughout the image formation process, to the cleaning blade 11*a* corresponding to the toner coat region 10R on the developing roller 10*d*. Therefore, a concern arises in that when the longitudinal width of the waste toner transport member 12*b* is set to be smaller than the longitudinal width of the toner coat region 10R, a region may form in which waste toner that should originally be transported can no longer be transported. That is, a region may form in which waste toner cannot be transported at a portion corresponding to the inward side of the toner coat region 10R.

In the present Embodiment 2, therefore, the relationship between longitudinal widths of the cleaning blade 11*a*, the waste toner transport member 12*b* and the toner coat region 10R is prescribed to obey "longitudinal width of the cleaning blade 11*a*>longitudinal width of the waste toner transport member 12*b*>longitudinal width of the toner coat region 10R". As described in Embodiment 1, waste toner transported by the waste toner transport member 12*b* in the vicinity of the longitudinal-direction ends of the cleaning blade 11*a* is suppressed by setting the longitudinal width of the waste toner transport member 12*b* to be smaller than the longitudinal width of the cleaning blade 11*a*. In addition thereto, the longitudinal width of the waste toner transport member 12*b* is set to be larger than the longitudinal width of the toner coat region 10R. As a result the supplied waste toner can be reliably transported, by the waste toner transport member 12*b*, to the vicinity of the leading end of the cleaning blade 11*a* corresponding to the toner coat region 10R to which waste toner is supplied constantly during the image formation process. In consequence, a region in which waste toner cannot be transported does not form, at a portion corresponding to the inward side of the toner coat region 10R.

By satisfying these relationships it becomes possible to achieve waste toner transport amounts both at the longitudinal-direction ends of the cleaning blade 11*a* and at the central portion in the longitudinal direction. That is, tuck-up of the cleaning blade 11*a* can be suppressed, and the supplied waste toner can be transported reliably to the waste toner accommodating portion 11*c*.

In the present Embodiment 2 the longitudinal width of the cleaning blade 11*a* was set to 240 mm, the longitudinal width of the waste toner transport member 12*b* was set to 226 mm, and the longitudinal width of the toner coat region 10R was set to 220 mm. A distance T1 between the leading end of the rubber part 11*a*1 of the cleaning blade 11*a* and the leading end of the scooping sheet 11*b* was set to about 2 mm. As illustrated in FIG. 7, a distance X between the ends of the waste toner transport member 12*b* and respective ends of the toner coat region 10R, and a distance Y between the ends of the cleaning blade 11*a* and respective ends of the waste toner transport member 12*b* are defined. A relationship between distance X and distance Y was prescribed herein to obey "distance Y>distance X". By doing so tuck-up of the cleaning blade 11*a* can be suppressed yet more reliably, and waste toner at the waste toner transport member 12*b* can be reliably transported. In the present Embodiment 2, distance X=3 mm and distance Y=7 mm, but the distances are however to be set as appropriate, depending on the apparatus configuration.

The toner coat region 10R on the developing roller 10*d* is a region, on the developing roller 10*d*, that can be coated with toner by the developing unit 10. The longitudinal ends of the toner coat region 10R may be the longitudinal ends of the developing blade 10*e*, or the longitudinal ends of the opening of the accommodating container 14, on the side on which the developing roller 10*d* is attached. In short, the longitudinal ends of the toner coat region 10R may be longitudinal ends at a region at which the developing roller 10*d* can be coated with toner.

Embodiment 3

A third example of the present invention will be explained next.

In the present Embodiment 3, a configuration will be explained in which the transport amount of waste toner differs between the longitudinal-direction ends of the waste toner transport member 12*b* and portions other than the longitudinal-direction ends. Specifically, the configuration of Embodiment 3 provides adjustment portion for adjusting the transport amount of toner by the waste toner transport member 12*b* in such a manner that the ends (end region) of the waste toner transport member 12*b* in the longitudinal direction are smaller than in a region (in particular, a central region) excluding those ends.

Features not particularly described in Embodiment 3 are identical to those in the examples above, and will not be explained again herein.

Figure 8A:
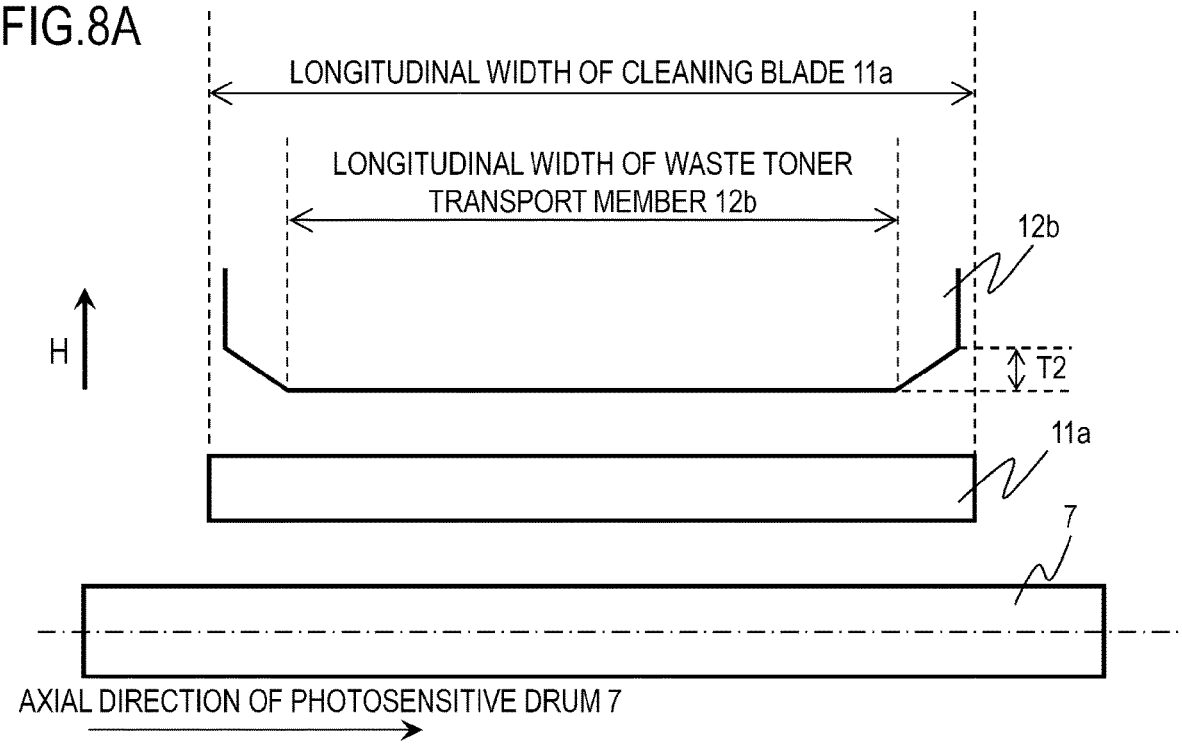
FIG. 8A and FIG. 8B are a set of explanatory diagrams of a waste toner transport member in Embodiment 3.
Figure 8B:
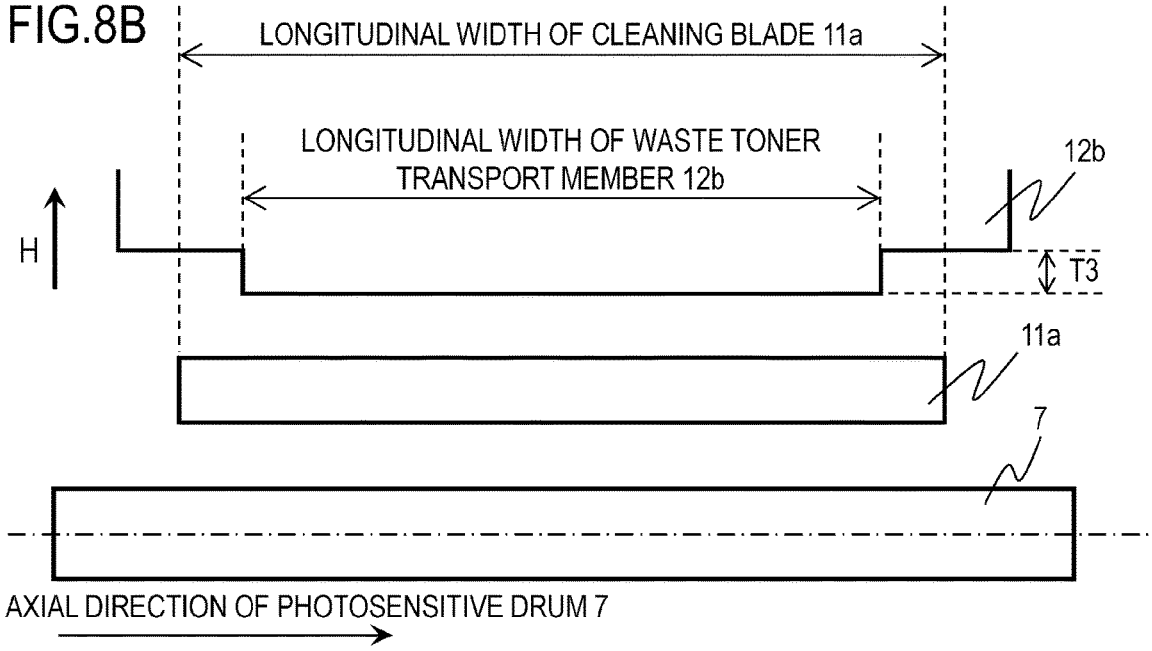

As illustrated in FIG. 8A and FIG. 8B, in the configuration of the present Embodiment 3 the shape of the upstream end of the waste toner transport member 12*b* is set to be different from that in Embodiment 1. The width of the upstream end of the waste toner transport member 12*b* in the longitudinal direction was set to be smaller than that of the cleaning blade 11*a*. In the present Embodiment 3 the longitudinal width of the upstream end of the waste toner transport member 12*b* was set to 220 mm, in FIG. 8A and FIG. 8B. In this example, distance T2=5 mm and distance T3=5 mm, as the level differences in the shape of the longitudinal-direction ends of the waste toner transport member 12*b*.

In FIG. 8A the shape of the longitudinal-direction ends of the waste toner transport member 12*b* was cut obliquely. Accordingly, the waste toner transport amount at the portions cut obliquely is curtailed as compared with a portion of the waste toner transport member 12*b* other than the longitudinal-direction ends. In FIG. 8B the shape of the longitudinal-direction ends of the waste toner transport member 12*b* is stepped. Specifically, the waste toner transport member 12*b* has a portion (first portion) in which a region that is longer than the longitudinal width (abutting width) of the abutting portion of the cleaning blade 11*a* with the photosensitive drum 7 is formed, and a portion (second portion) in which a region that is shorter than the longitudinal width (abutting width) of the abutting portion of the cleaning blade 11*a* with the photosensitive drum 7 is formed. As a result and thanks to the presence of such stepped portions, it becomes possible to keep small the waste toner transport amount from the vicinity of the longitudinal-direction ends of the cleaning blade 11*a* as compared with a portion of the waste toner transport member 12*b* other than the longitudinal-direction ends thereof. That is, the waste toner transport amount at the longitudinal-direction ends of the waste toner transport member 12*b* can be reduced by modifying the shape of the longitudinal-direction ends of the waste toner transport member 12*b*. In consequence, waste toner transport from the vicinity of the longitudinal-direction ends of the cleaning blade 11*a* is suppressed, and waste toner accumulates readily in the vicinity of the longitudinal-direction ends of the cleaning blade 11*a*. As a result, lubricity at the cleaning portion 11*a*3 is ensured, and tuck-up of the cleaning blade 11*a* can be suppressed.

Embodiment 4

A fourth example of the present invention will be explained next.

In the present Embodiment 4, a configuration will be explained (configuration in which an adjustment portion of a toner transport amount is provided) where the waste toner transport amount at the longitudinal ends of the waste toner transport member 12*b* is reduced, in a case where the longitudinal width of the waste toner transport member 12*b* is larger than the longitudinal width of the cleaning blade 11*a*.

Features not particularly explained in Embodiment 4 are identical to those in the examples above, and will not be explained again herein.

Figure 9:
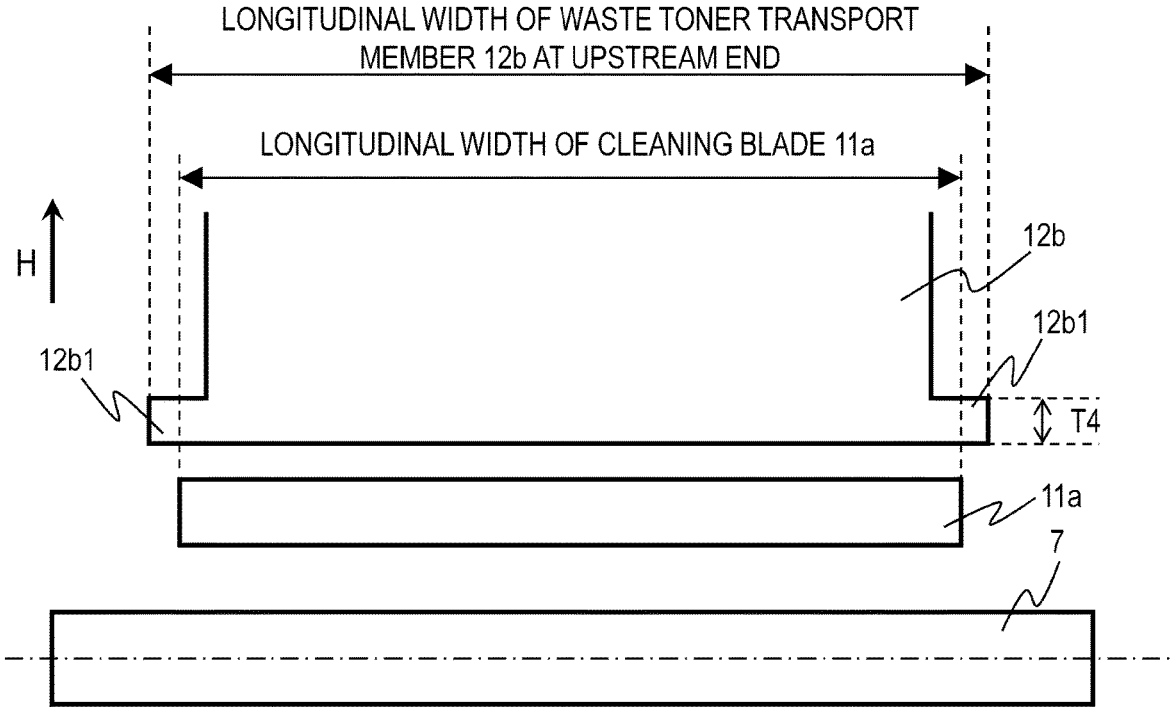
FIG. 9 is an explanatory diagram of a waste toner transport member in Embodiment 4.

As compared with the configuration of Embodiment 1 described above, in the configuration of the present Embodiment 4, as illustrated in FIG. 9, extension portions 12*b*1 are disposed only at the upstream end of the waste toner transport member 12*b*, up to the outward sides of the cleaning blade 11*a* in the longitudinal direction. Herein the length T4 of the extension portions 12*b*1 in the waste toner transport direction H was set to T4=3 mm.

The waste toner transport member 12*b* is formed herein so that the longitudinal width thereof is not even, in the waste toner transport direction H. As described above, the longitudinal width of the upstream end of the waste toner transport member 12*b* in the waste toner transport direction H is greater (first portion) than the longitudinal width of the cleaning blade 11*a*, on account of the presence of the extension portions 12*b*1. Meanwhile at a portion (second portion) other than the upstream end of the waste toner transport member 12*b* where the extension portions 12*b*1 are not present, the longitudinal width of the upstream end of the waste toner transport member 12*b* in the waste toner transport direction H is smaller than the longitudinal width of the cleaning blade 11*a*. On the extension portions 12*b*1, therefore, the transport amount of the waste toner at the longitudinal-direction ends of the waste toner transport member 12*b* is comparable to that of the waste toner at a portion other than the longitudinal-direction ends. However when waste toner is transported up to a region at which the extension portions 12*b*1 are no longer present, in the waste toner transport direction H, the waste toner remains at that portion. The retained waste toner pushes back the waste toner transported by the waste toner transport member 12*b*. As a result, the amount of waste toner transported at the longitudinal-direction ends of the waste toner transport member 12*b* is curtailed as compared with a portion other than the longitudinal-direction ends. That is, waste toner accumulates readily in the vicinity of the longitudinal-direction ends of the cleaning blade 11*a*. As a result the lubricity at the cleaning portion 11*a*3 in the vicinity of the longitudinal-direction ends of the cleaning blade 11*a* can be ensured, and the occurrence of tuck-up of the cleaning blade 11*a* can be suppressed.

Embodiment 5

A fifth example of the present invention will be explained next.

In Embodiment 4 a configuration has been illustrated in which the extension portions 12*b*1 are provided at the upstream end of the waste toner transport member 12*b* in the waste toner transport direction H. However, configurations for reducing the waste toner transport amount at the longitudinal ends of the waste toner transport member 12*b*, in a case where the longitudinal width of the waste toner transport member 12*b* is larger than the longitudinal width of the cleaning blade 11*a*, are not limited to the configuration in Embodiment 4.

Figure 10A:
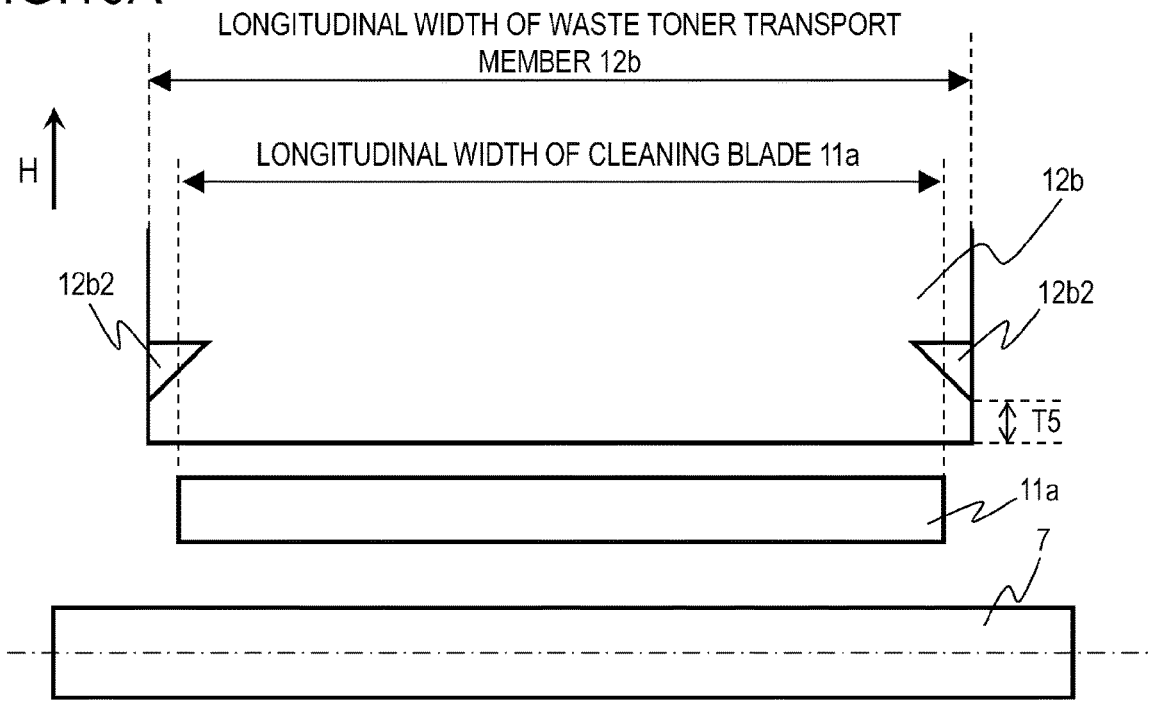
FIG. 10A and FIG. 10B are a set of explanatory diagrams of a waste toner transport member in Embodiment 5.
Figure 10B:
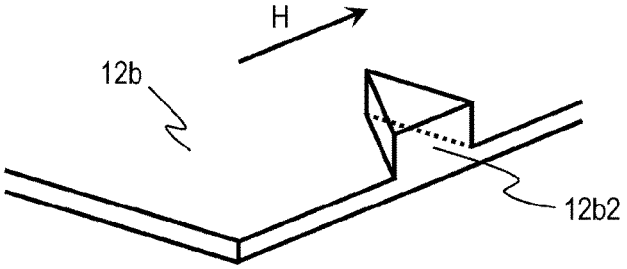

In the present Embodiment 5, as illustrated in FIG. 10A, the longitudinal width of the waste toner transport member 12*b* is larger than the longitudinal width of the cleaning blade 11*a*, over the entirety of the waste toner transport direction H. Further, projections 12*b*2 are provided at both ends of waste toner transport member 12*b* in the longitudinal direction. As illustrated in FIG. 10B, the projections 12*b*2 are disposed so as to protrude upwards from the top face of the waste toner transport member 12*b*. The projections 12*b*2 are disposed on respective extension lines of lines drawn from the longitudinal-direction ends of the cleaning blade 11*a* in the waste toner transport direction H. A distance T5 between the leading end of the waste toner transport member 12*b* up to the leading ends of the projections 12*b*2 was set to T5=3 mm.

Features not particularly explained in Embodiment 5 are identical to those in the examples above, and will not be explained again herein.

In the configuration of the present Embodiment 5, the projections 12*b*2 are provided at both ends of the waste toner transport member 12*b* in the longitudinal direction, and accordingly some of the waste toner is pushed back by the projections 12*b*2. That is, the waste toner transport at the longitudinal-direction ends of the waste toner transport member 12*b* is suppressed. In consequence, waste toner accumulates readily in the vicinity of the longitudinal-direction ends of the cleaning blade 11*a*. As a result, the lubricity at the cleaning portion 11*a*3 in the vicinity of the longitudinal-direction ends of the cleaning blade 11*a* can be ensured, and the occurrence of tuck-up of the cleaning blade 11*a* can be suppressed.

In the present Embodiment 5 an instance has been explained in which the projections 12*b*2 are disposed on the top face of the waste toner transport member 12*b*, but Embodiment 5 is not limited thereto. The projections 12*b*2 can be disposed at the lower face, or both of the top face and lower face, of the waste toner transport member 12*b*. In short, it suffices to adopt a configuration where transport of waste toner in the longitudinal-direction ends of the waste toner transport member 12*b* is suppressed, with the shape of the projections 12*b*2 not being limited to the shape illustrated in the present Embodiment 5.

Embodiment 6

A sixth example of the present invention will be explained next.

In Embodiment 4 a configuration has been illustrated in which the extension portions 12*b*1 are provided at the upstream end of the waste toner transport member 12*b* in the waste toner transport direction H. In Embodiment 5 a configuration has been illustrated in which projections 12*b*2 are disposed on the longitudinal-direction ends of the waste toner transport member 12*b*. However, configurations where the waste toner transport amount at the longitudinal ends of the waste toner transport member 12*b* is reduced, in a case where the longitudinal width of the waste toner transport member 12*b* is larger than the longitudinal width of the cleaning blade 11*a*, are not limited to the configurations in Embodiment 4 and Embodiment 5.

Figure 11:
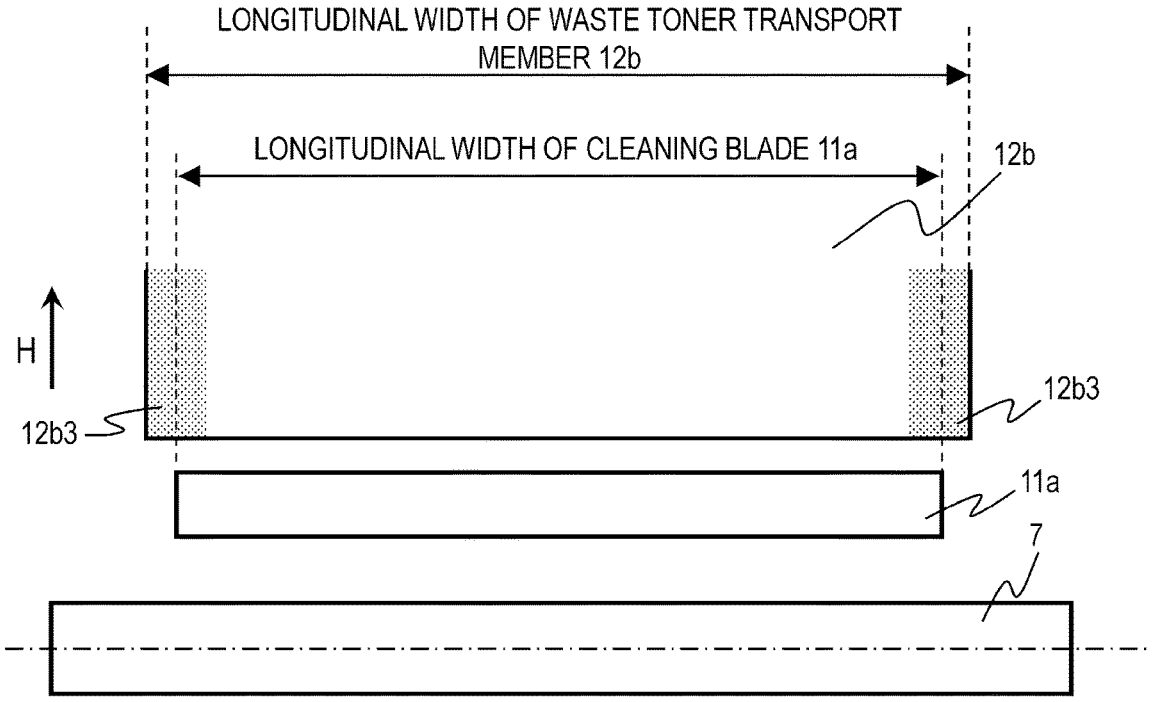
FIG. 11 is an explanatory diagram of a waste toner transport member in Embodiment 6.

In the present Embodiment 6, as illustrated in FIG. 11, the longitudinal width of the waste toner transport member 12*b* is larger than the longitudinal width of the cleaning blade 11*a*, over the entirety of the waste toner transport direction H, and smooth surface portions 12*b*3 are disposed at the longitudinal-direction ends of the waste toner transport member 12*b*. The smooth surface portions 12*b*3 (third portion) are disposed on extension lines of lines drawn from the longitudinal-direction ends of the cleaning blade 11*a*, in the waste toner transport direction H, as an adjustment region (first friction region) in which the toner transport amount is adjusted.

Features not particularly explained in Embodiment 6 are identical to those in the examples above, and will not be explained again herein.

In the configuration of the present Embodiment 6, a static friction coefficient μ1 of the waste toner transport member 12*b* towards waste toner at the region of the smooth surface portions 12*b*3 is smaller than a static friction coefficient μ2 towards waste toner at a region (fourth portion), as a second friction region, other than the smooth surface portions 12*b*3. In the present Embodiment 6, static friction coefficient μ1=0.8 and static friction coefficient μ2=1.0. In consequence, waste toner at the smooth surface portions 12*b*3 slips more readily than waste toner at a region other than the smooth surface portions 12*b*3, and thus the waste toner transport amount is suppressed. That is, waste toner accumulates readily in the vicinity of the longitudinal-direction ends of the cleaning blade 11*a*. As a result the lubricity at the cleaning portion 11*a*3 in the vicinity of the longitudinal-direction ends of the cleaning blade 11*a* can be ensured, and the occurrence of tuck-up of the cleaning blade 11*a* can be suppressed.

In addition thereto, the waste toner transport member 12*b* can be formed to be thinner than in Embodiment 5, and accordingly good waste toner transport can be achieved also in a configuration where the space between the cleaning blade 11*a* and the cleaning frame 11*d* is small.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-067307, filed on Mar. 29, 2019, which is hereby incorporated by reference herein in its entirety.

What is claimed is:

1. A cleaning unit, comprising:

a frame which is provided with an opening for attaching an image bearing member;

a blade member which has an abutting portion to abut on a surface of the image bearing member attached to the frame and which scrapes a developer from the surface of the image bearing member;

a transport sheet which is provided inside the frame and which transports the developer scraped by the blade member from an opening side of the frame to a deep side of the frame, the deep side being opposite to the opening side; and a driving unit which drives the transport sheet, wherein the transport sheet is driven by the driving unit such that an absolute value of maximum acceleration at the time of movement of the transport sheet in a direction from the opening side towards the deep side is smaller than an absolute value of maximum acceleration at the time of movement in a direction from the deep side towards the opening side, and wherein, in a longitudinal direction of the image bearing member, the width of the transport sheet is smaller than an abutting width of the blade member at the abutting portion, and an end of the transport sheet is disposed so as to be positioned inward of an end of the abutting portion.

2. The cleaning unit according to claim 1, wherein in an attitude during use, and in the longitudinal direction of the image bearing member, the width of the transport sheet is larger than the width of a developer coated region on a developer carrier that carries the developer for developing an electrostatic image formed on the image bearing member, and an end of the transport sheet is disposed so as to be positioned outward of the end of the developer coated region.

3. The cleaning unit according to claim 2, wherein in the longitudinal direction of the image bearing member, each one of the distances between both ends of the cleaning member and both ends of the transport sheet, is larger than each one of the distances between both ends of the transport sheet and both ends of the developer coated region, respectively.

4. The cleaning unit according to claim 1, wherein the cleaning unit includes a rotatable rotating shaft to which one end of the transport sheet is fixed, wherein the transport sheet fixed to the rotating shaft is disposed such that, in a state where the transport sheet is deflected, the other end of the transport sheet abuts on the blade member, and wherein the transport sheet is movable relatively with respect to the cleaning member, accompanying the rotation of the rotating shaft.

5. The cleaning unit according to claim 4, wherein the rotating shaft is disposed on the deep side of the frame.

6. The cleaning unit according to claim 4, wherein the transport sheet is provided with a through-hole that runs through in a thickness direction.

7. A cleaning unit, comprising:

a frame which is provided with an opening for attaching an image bearing member thereto;

a blade member which has an abutting portion to abut on a surface of the image bearing member attached to the frame and which scrapes a developer from the surface of the image bearing member;

a transport member which is provided inside the frame and which transports the developer scraped by the blade member from an opening side of the frame to a deep side of the frame, the deep side being opposite to the opening side; and a driving unit which drives the transport member, wherein the transport member is driven by the driving unit such that an absolute value of maximum acceleration at the time of movement of the transport member in a direction from the opening side towards the deep side is smaller than an absolute value of maximum acceleration at the time of movement in a direction from the deep side towards the opening side, and wherein the transport member is configured such that, in the longitudinal direction of the image bearing member, a transport amount of developer on the transport member is smaller at an end region than at a central region.

8. The cleaning unit according to claim 7, wherein the transport member is a transport sheet that transports developer disposed on a surface thereof, and wherein the cleaning unit further includes an adjustment portion for adjusting the transport amount of developer on the transport sheet in the longitudinal direction.

9. The cleaning unit according to claim 8, wherein the adjustment portion is a part of the transport sheet.

10. The cleaning unit according to claim 9, wherein the adjustment portion includes:

a first portion in which the width of the transport sheet is larger than the abutting width of the abutting portion of the blade member, in the longitudinal direction of the image bearing member, and a second portion in which the width of the transport sheet is smaller than the abutting width of the abutting portion of the blade member, in the longitudinal direction of the image bearing member, and wherein the first portion and the second portion are disposed at different positions in the transport direction of the developer, from the opening side towards the deep side.

11. The cleaning unit according to claim 10, wherein the adjustment portion is constructed such that:

a width of the transport sheet, in an upstream side region in the transport direction of the developer from the opening side towards the deep side, is smaller than the abutting width of the abutting portion of the blade member, in the longitudinal direction of the image bearing member, and a width of the transport sheet, in a region excluding the upstream side region in the transport direction of the developer from the opening side towards the deep side, is larger than the abutting width of the abutting portion of the blade member, in the longitudinal direction of the image bearing member.

12. The cleaning unit according to claim 10, wherein the adjustment portion is constructed such that:

a width of the transport sheet, in an upstream side region in the transport direction of the developer from the opening side towards the deep side, is larger than the abutting width of the abutting portion of the blade member, in the longitudinal direction of the image bearing member, and a width of the transport sheet, in a region excluding the upstream side region in the transport direction of the developer from the opening side towards the deep side, is smaller than the abutting width of the abutting portion of the blade member, in the longitudinal direction of the image bearing member.

13. The cleaning unit according to claim 9, wherein the adjustment portion includes:

a third portion in which a first friction region, where a static friction coefficient towards the developer is $\mu 1$, is formed in the transport sheet at both ends in the longitudinal direction of the image bearing member, and a fourth portion in which a region excluding the first friction region is formed as a second friction region in which a static friction coefficient towards the developer is $\mu 2(>\mu 1)$, and wherein in the longitudinal direction of the image bearing member, the third portion at which the first friction region is formed is disposed at positions overlapping both ends of the blade member.

14. The cleaning unit according to claim 8, wherein the adjustment portion has projections which are provided at both ends of the transport sheet in the longitudinal direction of the image bearing member and which protrude upwards from a top face of the transport sheet, and wherein in the longitudinal direction of the image bearing member, the projections are disposed at positions overlapping both ends of the blade member.

15. A cartridge attachable to and detachable from a main body of an image forming apparatus, the cartridge comprising:

an image bearing member;

a developer carrier that carries a developer for developing an electrostatic image formed on the image bearing member; and a cleaning unit, wherein the cleaning unit includes:

a frame which is provided with an opening for attaching the image bearing member, a blade member which has an abutting portion to abut a surface of the image bearing member attached to the frame and which scrapes a developer from the surface of the image bearing member, a transport sheet which is provided inside the frame and which transports the developer scraped by the blade member, from an opening side of the frame to a deep side of the frame, the deep side being opposite to the opening side, and a driving unit which drives the transport sheet, wherein the transport sheet is driven by the driving unit such that an absolute value of maximum acceleration at the time of movement of the transport sheet in a direction from the opening side towards the deep side, is smaller than an absolute value of maximum acceleration at the time of movement in a direction from the deep side towards the opening side, and wherein, in a longitudinal direction of the image bearing member, the width of the transport sheet is smaller than an abutting width of the blade member at the abutting portion, and an end of the transport sheet is disposed so as to be positioned inward of an end of the abutting portion.

16. An image forming apparatus, comprising:

a main body; and a cartridge attachable to and detachable from the main body, wherein the cartridge includes:

an image bearing member, a developer carrier that carries a developer for developing an electrostatic image formed on the image bearing member, and a cleaning unit, wherein the cleaning unit includes:

a frame which is provided with an opening for attaching the image bearing member, a blade member which has an abutting portion to abut a surface of the image bearing member attached to the frame and which scrapes a developer from the surface of the image bearing member, a transport sheet which is provided inside the frame and which transports the developer scraped by the blade member, from an opening side of the frame to a deep side of the frame, the deep side being opposite to the opening side, and a driving unit which drives the transport sheet, wherein the transport sheet is driven by the driving unit such that an absolute value of maximum acceleration at the time of movement of the transport sheet in a direction from the opening side towards the deep side, is smaller than an absolute value of maximum acceleration at the time of movement in a direction from the deep side towards the opening side, and wherein, in a longitudinal direction of the image bearing member, the width of the transport sheet is smaller than an abutting width of the blade member at the abutting portion, and an end of the transport sheet is disposed so as to be positioned inward of an end of the abutting portion.

* * * * *